US005191340A

United States Patent [19]

Brandao et al.

[11] Patent Number: 5,191,340

[45] Date of Patent: Mar. 2, 1993

[54] NEUTRALIZATION NETWORK FOR MULTIELEMENT ANTENNA

[75] Inventors: Ruy L. Brandao, Fort Lauderdale; Anthony Parker; Randall C. Spires, both of Boca Raton, all of Fla.

[73] Assignee: Allied-Signal Inc., Morris Township, Morris County, N.J.

[21] Appl. No.: 746,384

[22] Filed: Aug. 16, 1991

[51] Int. Cl.[5] ..... H01Q 3/22; H01Q 3/24; H01Q 3/26

[52] U.S. Cl. ..... 342/373; 342/424

[58] Field of Search ..... 342/373, 424

[56] References Cited

U.S. PATENT DOCUMENTS

| | | | |
|---|---|---|---|
| 4,855,748 | 8/1989 | Brandao et al. | 342/455 |
| 4,876,548 | 10/1989 | Lopez | 342/368 |
| 5,003,315 | 3/1991 | Skatvold, Jr. | 342/373 |
| 5,028,930 | 7/1991 | Evans | 342/373 |

*Primary Examiner*—Theodore M. Blum
*Attorney, Agent, or Firm*—Donald B. Paschburg; Howard G. Massung

[57] ABSTRACT

A distributed network that compensates for the effects of interelement coupling in a multielement antenna array is inserted between the output of an antenna array and the inputs of a receiver system. Within the distributed network are a plurality of couplers interconnected by transmission lines serving as phase shifters. The coupling factors of the various couplers and the lengths of the transmission lines are selected so as to apply voltage components of specific amplitudes and phase to the antenna ports. The values of the amplitudes and phases of these voltage components are such as to neutralize the components of the voltages at the output of the antenna array which are caused by the spatial couplings between the elements of the antenna array.

6 Claims, 3 Drawing Sheets

NEUTRALIZATION NETWORK FOR MULTIELEMENT ANTENNA

BACKGROUND OF THE INVENTION

1. Field of the Invention

The present invention relates to a neutralization network for compensating for the effects of interelement coupling in an antenna array. More particularly, it relates to a network for coupling a portion of the signal received at each of the elements of an antenna array to all the other elements of the antenna array in proper amplitude and phase to compensate for the signal spatially coupled from each of the antenna elements excited by an incident signal to all the other elements of the antenna array.

2. Description of the Prior Art

In certain antenna array applications attempts have been made to achieve particular results by combining the signals induced in or radiated by the elements of an antenna array as if such signals originated from independent, coherent sources. For instance, two closely spaced pairs of antenna elements positioned orthogonally have been used as a direction finding antenna to determine the relative bearing of a distant source from the antenna array. Such an array is known in the art as an interferometer. Theoretically, the phase difference between the signals received by the opposite elements of one pair of the antenna array varies by sin $\beta$ and the phase difference between signals received by the opposite elements of the other pair of the antenna array varies by cos $\beta$, where $\beta$ is the relative bearing angle from the antenna array to the source. The relative bearing angle $\beta$ is then found from the relationship:

$$\beta = tan^{-1}[sin\ \beta / cos\ \beta].$$

The above relationship holds true only if there is no interaction between the elements of the antenna array. In actuality, each of the elements of the antenna array reflects a portion of the incident wave toward all the other elements of the antenna array so that the true signal at each of the elements of the antenna array is a composite of the signal directly received at that element together with the signals reflected to that element from all the other elements of the antenna array. As a result, the phase and amplitude of the signals at each of the elements of the antenna array differ from the phase and amplitude of the signals which would be received by each of the elements of the antenna array if those elements were isolated from one another. Consequently, the relative bearing angle $\beta$ determined by phase comparison of the signals received by the elements of the antenna array is in error and such error varies with changes in the relative bearing angle $\beta$.

U.S. Pat. No. 4,855,748, issued Aug. 8, 1989 to R. L. Brandao et al. for "TCAS Bearing Estimation Receiver Using A 4 Element Antenna" and assigned to the same assignee as the present invention, discloses a receiver system that employs a four element antenna array of the interferometer type designed for use in the Traffic Alert and Collision Avoidance System (TCAS). The receiver system determines the relative bearing angle $\beta$ between the protected aircraft upon which the receiver is mounted, to an intruding aircraft, by comparing the phase of the signals from the intruding aircraft received by the opposite elements of the four element antenna array. The relative bearing angle $\beta$ is then computed from the above-stated relationship.

The receiver system includes means for determining and compensating for: (a) differences in phase delay between the transmission lines connecting the antenna elements to the receiver input; (b) differences in phase delay between the four receiver channels preceding phase detection; and (c) errors caused by phase detector non-linearities. Thus, compensation is made for phase errors originating within the receiver system but the error in $\beta$ (computed) caused by interaction of the elements of the antenna array remains uncorrected.

It is the primary object of the present invention to provide means for compensating for the effects of interelement coupling in a closely spaced multielement antenna array.

It is another object of the present invention to provide a network for coupling a portion of the signal induced in each element of a multielement antenna array to all the other elements of the antenna array in proper amplitude and phase so as to neutralize that portion of the signal induced in each antenna array element by reflections of an incident wave from all the other elements of the antenna array.

It is a further object of the present invention to provide a means for reducing errors in the measurement of relative bearing angles in applications involving a direction finding antenna of the interferometer type.

These and other objects and advantages of the present invention will become evident as an understanding of the invention is gained from the following complete description thereof and the accompanying drawings.

SUMMARY OF THE INVENTION

Briefly, the present invention comprises a distributed network that compensates for the effects of interelement coupling in a multielement antenna array and is inserted between the output of the antenna array and the inputs to a receiver system. The network includes a plurality of input ports, corresponding in number to the number of elements of the antenna array, and a plurality of output ports, equal in number to the number of input ports of the receiver system. The antenna elements and the network output ports are respectively connected to the network input ports and to the receiver system input ports by individual transmission lines. Within the network are a plurality of couplers interconnected by transmission lines serving as phase shifters. The coupling factors of the various couplers and the lengths of the transmission lines (phase shifters) are selected so as to apply voltage components of specific amplitudes and phases to the antenna ports. The values of the amplitudes and phases of these voltage components, ideally, are such as to neutralize the components of the voltages at the output ports of the antenna array which are caused by the spatial couplings between the elements of the antenna array.

DETAILED DESCRIPTION OF THE INVENTION

Figure 1:
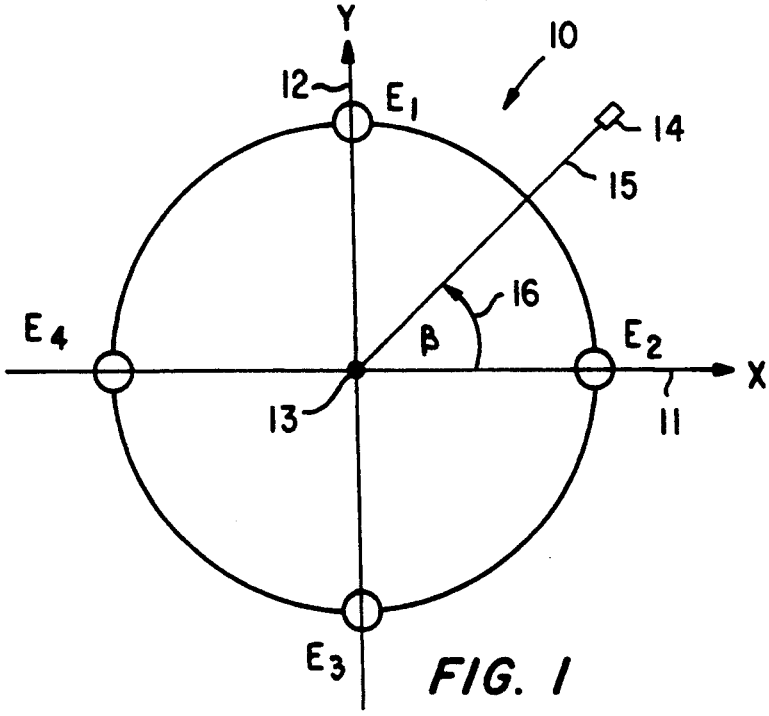
FIG. 1 illustrates a four element circular antenna array.

The present invention provides a means of changing the effective coupling between the elements of an antenna array in order to optimize the antenna performance. The specific hardware used to develop this concept was a typical four element circular antenna array as illustrated in FIG. 1. In principle however, the neutralization network of the present invention can be applied to an arbitrary size, n element, antenna array as long as access is provided to the element ports.

One application of the neutralization network of the present invention is to effectively neutralize the inter-elemental coupling of an antenna array. Another application of the neutralization network is to control the inter-elemental coupling and therefore produce improved performance. An important advantage of this application is that by properly adjusting the amplitude and phase of the coupling for a given element spacing, an increase in differential phase excursion between the elements is achieved. The amplitude of the phase excursion between adjacent elements is particularly important in bearing measurement systems that use differential phase information. It is important to note that due to the inherent physical proximity of the antenna elements (especially the adjacent elements), coupling will be present and in most cases cannot be controlled to optimize performance. The present invention allows for independent control of coupling in order to optimize the antenna performance.

FIG. 1 illustrates a circular array 10 comprised of four antenna elements E1, E2, E3 and E4. Elements E2 and E4 are located on X axis 11 which is preferably alligned with the heading axis of the aircraft. Elements E1 and E3 are located on Y axis 12 which intersects X axis 11 perpendicularly at center 13 of circular array 10. Elements E1–E4 are each spaced equal distances, preferably one-quarter wavelength, from center 13 of circular array 10. A signal source 14 radiates electromagnetic waves along path 15 between center 13 and signal source 14. The angle between circular array 10 and signal source 14 is relative bearing angle $\beta$ 16.

For the four element circular antenna array, the matrices above reduce to:

$$[U] = \begin{bmatrix} u1 \\ u2 \\ u3 \\ u4 \end{bmatrix}; [V] = \begin{bmatrix} v1 \\ v2 \\ v3 \\ v4 \end{bmatrix};$$

$$[A] = \begin{bmatrix} 1, & a12, & a13, & a14 \\ a21, & 1, & a23, & a24 \\ a31, & a32, & 1, & a34 \\ a41, & a42, & a43, & 1 \end{bmatrix}$$

Matrix "A" represents the effective voltage coupling amplitude and phase shift among the four elements of the antenna. The elements of this matrix aij are complex numbers expressing amplitude and phase. From the above it follows that by designing a four port network having a transfer function which is the inverse of coupling matrix [A], then by connecting this network to the elements, the effect of coupling would be neutralized.

This conclusion can also be expressed in matrix form. By defining [N]=neutralization network=[1/A] and by then applying the neutralization network to the actual antenna ports, the following results are obtained:

$$[N]\times[U]=[1/A]\times[A]\times[V]=[V]$$

Figure 3:
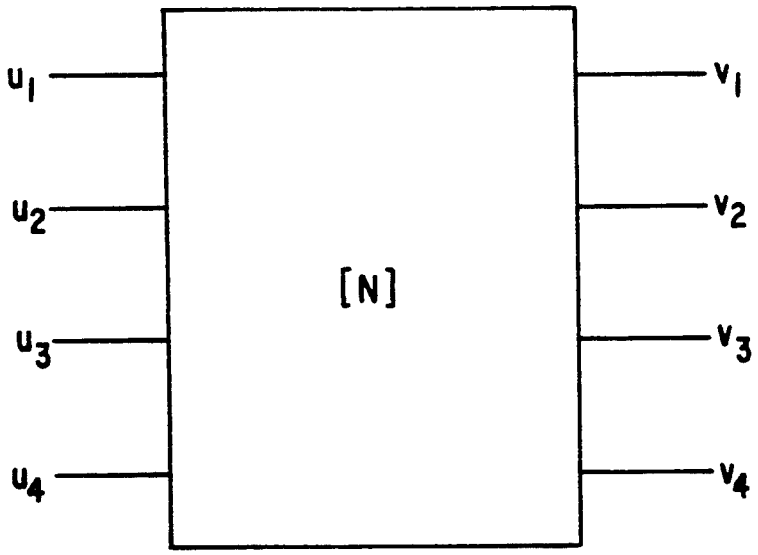
FIG. 3 illustrates the effects of the neutralization network of the present invention.

This conclusion, as illustrated in FIG. 3, shows that the elemental complex voltages, with coupling ui, after being compensated by neutralization network [N], become identical to the original uncoupled elemental voltages vi.

The following will describe the implementation of the neutralization network. A four element L band circular array antenna with radius of ¼ of a wavelength was used to develop the neutralization network. The coupling between antenna elements was measured at three frequencies and is presented here as amplitude ratios in db and phase in degrees. These measurements are referred in the art as "S" parameters.

| | 1030 MHZ | 1060 MHZ | 1090 MHZ |
|---|---|---|---|
| | | ADJACENT ELEMENTS | |
| S12= | −12.2 db −175 deg | −11.9 db 126 deg | −11.9 db 73 deg |
| S23= | −12.4 db −176 deg | −12.0 db 123 deg | −11.6 db 70 deg |
| S34= | −12.6 db −177 deg | −11.6 db 128 deg | −11.4 db 75 deg |
| S41= | −12.2 db −172 deg | −11.4 db 131 deg | −11.6 db 79 deg |
| | | OPPOSITE ELEMENTS | |
| S31= | −23.8 db 108 deg | −25.4 db 89 deg | −26.7 db 65 deg |
| S42= | −24.8 db 124 deg | −24.6 db 99 deg | −24.7 db 81 deg |

With a circular antenna array, such as is illustrated in FIG. 1, composed of four elements E1, E2, E3 and E4 we can establish the following:

aij=coupling amplitude and phase shift between elements Ei and Ej;

vi=complex voltage developed from a far field source on element i assuming no coupling; and, ui=complex voltage developed from a far field source on element i with coupling included.

Figure 2:
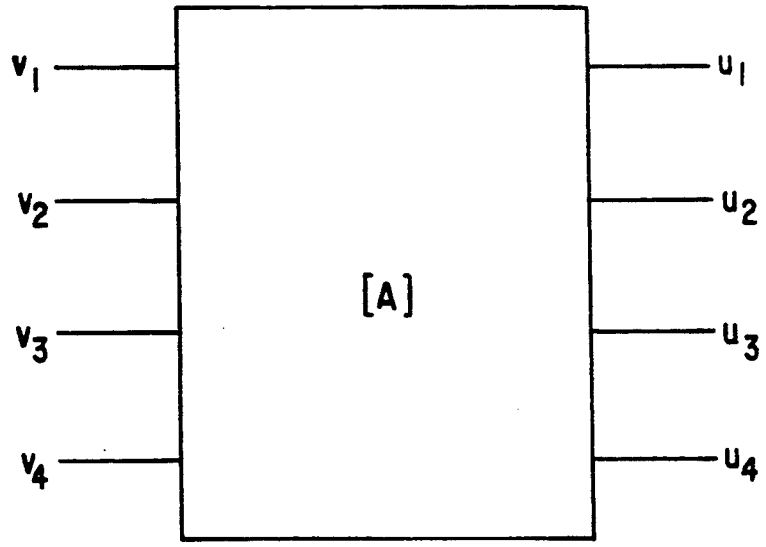
FIG. 2 illustrates the effects of coupling.

The relationship between ui and vi can then be expressed in matrix form as [U]=[A]×[V] as illustrated in FIG. 2.

The adjacent coupling amplitude and phase shift s12,s23,s34,s41 are approximately the same (due to antenna symmetry) and are substantially greater than the opposite coupling amplitude and phase shift, s31,s42. For the purposes of this example, the adjacent couplings are considered equal and the opposite couplings are considered equal. This particular implementation of the neutralization network reduced coupling among the adjacent elements, which are the strongest couplings, without increasing coupling among the opposite elements.

Neutralization of elemental mutual coupling can be accomplished by using an RF isolation enhancement network to provide increased element isolation. The neutralization network was simulated by using Touchstone, known in the art as a computer-aided engineering software program for RF and microwave analysis and optimization. Derivation of the 8 couplers and 4 transmission lines was done by running the simulated network attached to the antenna on Touchstone's optimization routine. Coupling line spacing and transmission line lengths were varied to maximize the isolation between antenna elements.

Figure 4:
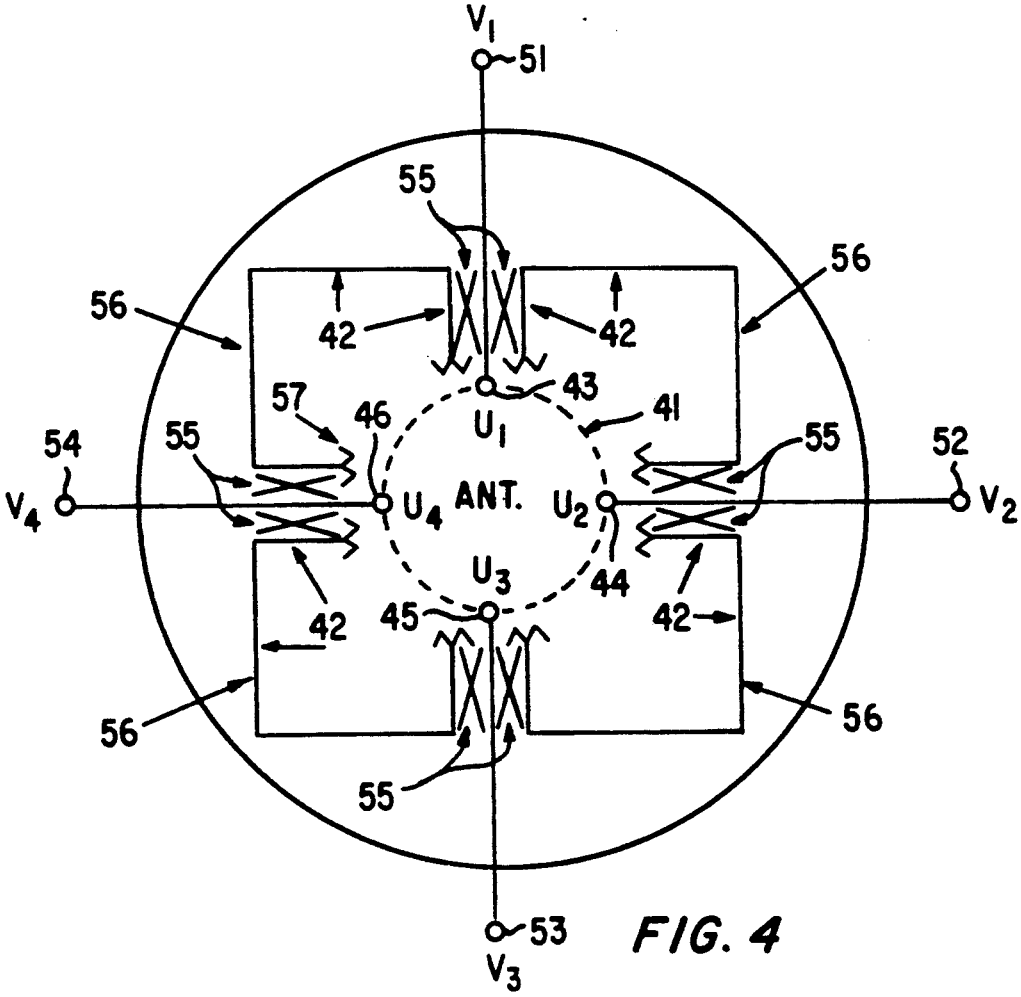
FIG. 4 illustrates a schematic of an antenna with the neutralization network of the present invention.

FIG. 4 illustrates an antenna 41 and one embodiment of the present invention, a neutralization network 42 designed to increase the isolation (minimize Sij) between antenna ports 43–46 and receiver inputs 51–54. The neutralization network 42 comprises eight couplers 55, eight coupler port terminators 57, and four transmission lines 56 which are used as phase shifters. The design objective of the present invention is to reduce the coupling between the adjacent elements without increasing the coupling between the opposite elements. This is accomplished by adjusting the phase shift in the network between the adjacent elements by adjusting the coupling line lengths, and adjusting the amplitude coupling between the adjacent elements by adjusting the coupling line spacing. The actual values of the coupling amplitude and phase shift should not equal the Sij parameter amplitude and phase since exact cancelling of the adjacent coupling would have an effect of increasing the opposite coupling. Also, there are no physical couplers or phase shifters between the opposite elements. The only opposite element coupling present is via the electromagnetic field.

Figure 5:
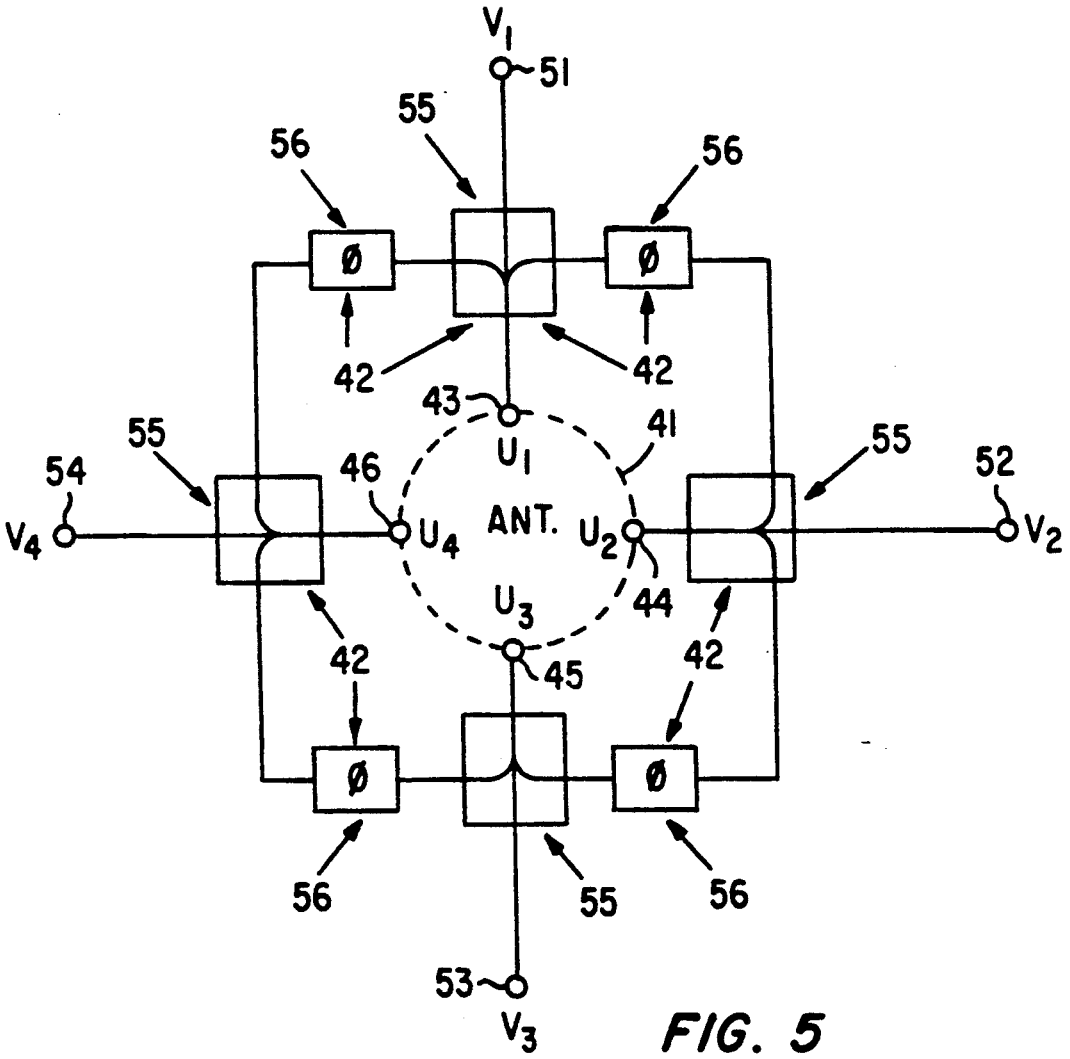
FIG. 5 illustrates a block diagram of an antenna with the neutralization network of the present invention.

FIG. 5 illustrates a block diagram of the antenna and neutralization network 42. Far field signals arrive at antenna ports 43–46 (U1–U4) as uncompensated outputs on antenna 41 as previously defined. These signals are coupled between adjacent elements via eight directional couplers 55 and four phase shifters 56 which comprise the neutralization network. The coupling amplitude adjustment is accomplished by adjusting the line spacing of the couplers. The coupling phase adjustment is accomplished by adjusting the line lengths between the adjacent elements. The effect of the neutralization network provides output signals at ports 51–54 that are controlled coupled responses.

Simulation of this example resulted in an improved adjacent isolation of 10.6 db. Table I illustrates the effect of the neutralization network on the adjacent antenna elements. As seen in Table I, the increased isolation for adjacent antenna elements varies from a minimum of 5.30 db at 1030 Mhz. to a maximum of 8.4 db at 1060 Mhz. with an isolation improvement in the opposite element coupling also.

TABLE I

| | | | MEASURED ELEMENT COUPLING AND NEUTRALIZATION | | | |
|---|---|---|---|---|---|---|
| FREQ (MHZ) (DB) | ADJ COUPLING (DB) | ADJ COUPL W/NEUTRAL (DB) | ADJ ISOLATION IMPROVEMENT (DB) | OPP COUPLING (DB) | OPP COUPL W/NEUTRAL (DB) | OPP ISOLATION IMPROVEMENT (DB) |
| 1030 | −12.20 | −17.5 | 5.30 | −24.8 | −26.0 | 1.2 |
| 1060 | −11.60 | −20.0 | 8.40 | −24.6 | −28.0 | 3.4 |
| 1090 | −11.60 | −17.0 | 5.40 | −24.7 | −30.0 | 5.3 |

It is not intended that this invention be limited to the hardware or software arrangement, or operational procedures shown disclosed. This invention includes all of the alterations and variations thereto as encompassed within the scope of the claims as follows.

We claim:

1. An improved neutralization network for a multielement antenna of the type including means for compensating for effects of interelement coupling in a closely spaced multielement antenna in order to optimize performance, the improvement comprising:

the means for compensating disposed between output ports of said closely spaced multielement antenna and input ports of a receiver system, and including a plurality f network input ports corresponding in number to a number of elements of said closely spaced multielement antenna and a plurality of network output ports corresponding in number to a number of input ports of the receiver system;

each of said elements and said plurality of network output ports being respectively connected to each of said plurality of network input ports of said receiver system by individual transmission lines; and network means for coupling a portion of a signal induced in each element of said closely spaced multielement antenna to all other elements of said closely spaced multielement antenna in proper amplitude and phase so as to neutralize said portion of said signal induced in each element by reflections of an incident wave from all other elements of said closely spaced multielement antenna.

2. A neutralization network for a multielement antenna as claimed in claim 1 wherein said means for compensating comprises:

means for reducing errors in measurements of relative bearing angles in applications involving a direction finding antenna of interferometer type.

3. A neutralization network for a multielement antenna as claimed in claim 1 wherein said means for compensating further comprises a plurality of couplers interconnected by a plurality of said individual transmission lines serving as phase shifters.

4. A neutralization network for a multielement antenna as claimed in claim 3 wherein coupling factors of each of said plurality of couplers and lengths of each of said plurality of transmission lines are selected so as to apply voltage components of specific amplitudes and phases to each of said elements of said closely spaced multielement antenna.

5. A neutralization network for a multielement antenna as claimed in claim 4 wherein values of said specific amplitudes and phases of said voltage components are such as to neutralize antenna voltage components at output ports of said closely spaced multielement antenna which are caused by couplings between elements of said closely spaced multielement antenna.

6. A neutralization network for a multielement antenna as claimed in claim 3 wherein said means for compensating comprises adjustment means for properly adjusting amplitude and phase of each of said plurality of couplers therefore providing an increase in differential phase excursion between said elements.

* * * * *